United States Patent [19]

Rehfeld

[11] 4,010,968

[45] Mar. 8, 1977

[54] LATCH GUARD

[75] Inventor: Arthur W. Rehfeld, Arleta, Calif.

[73] Assignee: Lawrence Peska Associates, Inc., New York, N.Y. ; a part interest

[22] Filed: Mar. 10, 1976

[21] Appl. No.: 665,525

[52] U.S. Cl. ..... 292/346; 340/274 R

[51] Int. Cl.[2] ..... E05C 1/12

[58] Field of Search ..... 292/340, 346; 70/49; 340/274, 276

[56] References Cited

UNITED STATES PATENTS

| | | | |
|---|---|---|---|
| 2,660,632 | 11/1953 | Makishima | 340/274 R X |
| 3,392,999 | 7/1968 | Thompson | 292/346 |

*Primary Examiner*—Richard E. Moore

*Attorney, Agent, or Firm*—Erwin S. Teltscher

[57] ABSTRACT

In a latch guard which has a mounting flange mountable in overlying relation to the inner face of a jamb in the vicinity of keeper means located on the jamb, and a blocking flange integrally fixed along one edge of the mounting flange substantially at right angles thereto, the improvement wherein a portion of the blocking flange projecting along and beyond the full length of a recess formed in the mounting flange in a direction away from a door has a plurality of toothed segments formed therein. The latch guard further includes a conductive plate which lies in the second plane paralleling the first plane and is normally spaced therefrom in a direction away from the door. At least one nonconductive compression spring is interposed between the plate and the blocking flange to urge the plate in a direction away therefrom. The stop and the jamb are formed with first and second recesses, respectively to receive blocking flange, the spring and the plate. The blocking flange and the plate are formed with projections facing one another, respectively; the blocking flange is conductive. and the flange and the plate are electrically connected to an intruder-warning system. Upon an intruder attempting to selectively jam a prying tool between the jamb and the stop, or between the door and the stop, the projections are electrically connected to one another and actuate warning means.

1 Claim, 3 Drawing Figures

LATCH GUARD

BACKGROUND OF THE INVENTION

1. Field of the Invention

The field of the invention relates to a latch guard for a lock.

2. Description of the Prior Art

A lock guard is known which includes a mounting flange which overlies the jamb face of a door in surrounding relation to the keeper plate, and a blocking flange perpendicular to the mounting flange. Although any tool inserted between the door stop and the face of the jamb will be effectively blocked for further movement toward the latch or lock bolt, and an effective guarding of the lock bolt will be provided even upon complete removal of the door stop within the vicinity of the keeper plate, it will nevertheless be possible to remove the lock guard itself even though this presents a difficult and time-consuming task. Any burglar, however, who has an adequate amount of time, or judges that he has an adequate amount of time, will be able to penetrate the lock.

SUMMARY OF THE INVENTION

It is an object of the present invention to provide an immediate warning of any attempted unauthorized entry, so that appropriate action can then be taken immediately.

I therefore provide in a latch guard which has a mounting flange mountable in overlying relation to the inner face of a jamb in the vicinity of keeper means located on the jamb, and which has a blocking flange integrally fixed along one edge of the mounting flange substantially at right angles thereto, so as to lie in a first plane paralleling, and adapted to overlie the abutment face of a jamb-mounted stop, wherein the blocking flange projects laterally on a side of the mounting flange facing the door, and wherein the mounting flange has an enlarged recess defined centrally therein, the improvement in which a portion of the blocking flange which projects along and beyond the full length of the recess in a direction away from the door has a plurality of toothed segments formed therein. I further provide a conductive plate which lies in a second plane paralleling the first plane and is normally spaced therefrom in a direction away from the door. I interpose at least one non-conductive compression spring between the plate and the blocking flange for urging the plate in a direction away from the blocking flange. The stop and the jamb are formed with first and second recesses, respectively, to receive the blocking flange, the spring and the plate the blocking flange and the plate are formed with projections facing one another, respectively. The blocking flange is conductive, and the latter and the plate are electrically connected to intruder-actuated warning means, respectively. Upon an intruder attempting to jam a prying tool between the jamb and the stop, or between the door and the stop, the projections are electrically connected to one another and actuate the warning means.

BRIEF DESCRIPTION OF THE DRAWING

My invention will be better understood with reference to the accompanying drawing in which.

DESCRIPTION OF THE PREFERRED EMBODIMENT

Figure 1:
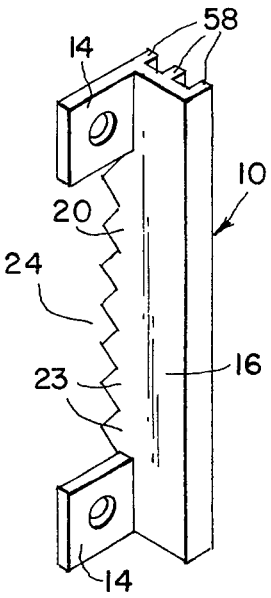
FIG. 1 shows the latch guard according to my invention.
Figure 2:
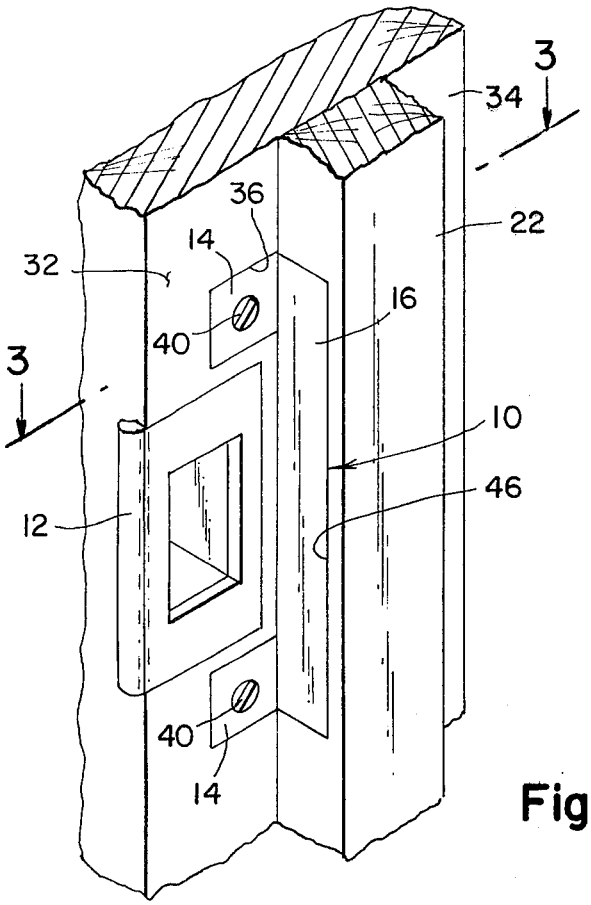
FIG. 2 is a perspective view of the portion of a door-jamb upon which the keeper or striker plate of a lock assembly is mounted with the latch guard of the present invention mounted in an operative position.
Figure 3:
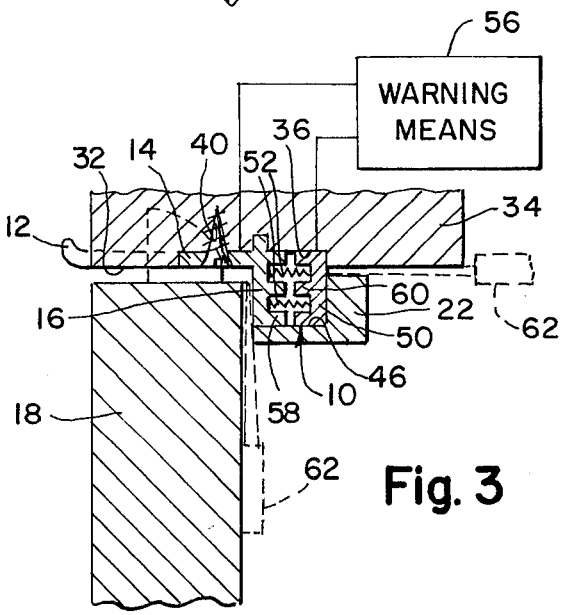
FIG. 3 is an enlarged cross-sectional view through the mounted latch guard.

Referring now more specifically to the drawing, the latch guard of the instant invention is generally designated by the reference numeral 10. This latch guard 10 is of a length substantially greater than that of the keeper or striker plate 12 with which it is to be used so as to extend a distance both vertically thereabove and vertically therebelow. The latch guard 10 includes mounting flanges 14 and a full length blocking flange 16 integrally secured to the mounting flanges 14 along one edge thereof, and at right angles thereto. The blocking flange 16 is disposed at right angles with respect to the mounting flange 14.

A recess 24 is formed between the mounting flanges 14, the recess 24 being of a length so as to easily accommodate the keeper plate 12 therein.

A portion 20 of the blocking flange 16 projects along and beyond the full length of the recess in a direction away from the door 18. The portion 20 is formed with a plurality of toothed segments 23 for improved engagement when fitted into a recess 36 of the door jamb 34. The inner face 32 of the door jamb will be therefore be formed with the recess 36 and the door stop 22 will correspondingly be formed with a recess 46. The recesses 36 and 46 are shaped to accommodate the blocking flange 16, and the latch guard 10 is attached to the door jamb 34 by means of screws 40. An electrically conductive plate 50 lies in a second plane which parallels the first plane and is normally spaced therefrom in a direction away from the door 18. Two non-conductive compression springs 52 are interposed between the plate 50 and the blocking flange 16 and urge the plate 50 in a direction away from the blocking flange 16. The stop 22 is formed with the recess 46, and the jamb 34 is formed with the recess 36 to receive the blocking flange 16, the springs 54 and the plate 50. The plate 50 and the flange 16 are formed with projections 58 and 60, respectively. The blocking flange 16 is conductive, and the latter and the plate 50 are electrically connected to an intruder-actuated warning means 56, respectively. When an intruder attempts to jam a prying tool 62 either between the jamb 34 and the stop 22, or between the stop 22 and the door 18, the projections 58 and 60 make electrical contact with one another and actuate the warning means 56.

Although the invention has been described with respect to a preferred form thereof, it is to be understood that it is not to be so limited since changes can be made therein which are within the full intended scope of this invention as defined by the appended claims.

What is claimed is:

1. In a latch guard having a mounting flange mountable in overlying relation to the inner face of a jamb in the vicinity of keeper means located on the jamb, and a blocking flange integrally fixed along one edge of the mounting flange substantially at right angles thereto so as to lie in a first plane paralleling, and adapted to overlie the abutment face of a jam-mounted stop, the blocking flange projecting laterally on a side of the mounting flange facing the door, the mounting flange having an enlarged recess defined centrally therein, the improvement wherein a portion of the blocking flange projecting along and beyond the full length of the recess in a direction away from the door has a plurality of toothed segments formed therein, and further comprising a conductive plate lying in a second plane paralleling the first plane and normally spaced therefrom in a direction away from the door, and at least one non-conductive compression spring being interposed between said plate and said blocking flange for urging said plate in a direction away from said blocking flange, and wherein the stop and the jamb are formed with first and second recesses, respectively to receive said blocking flange, said spring, and said plate, and wherein the blocking flange and said plate are formed with projections facing one another, respectively, the blocking flange is conductive, and the latter and said plate are adapted to be electrically coupled to an intruder-actuated warning means, respectively, whereby, upon an intruder attempting to selectively jam a prying tool between the jamb and the stop, and between the door and the stop, said projections make electrical contact with one another and actuate said warning means.

* * * * *